US011388946B2

(12) United States Patent
Polegato Moretti et al.

(10) Patent No.: US 11,388,946 B2
(45) Date of Patent: Jul. 19, 2022

(54) VAPOR-PERMEABLE INSERT FOR ITEMS OF CLOTHING AND ACCESSORIES, ITEM OF CLOTHING AND ACCESSORIES WITH SAID INSERT

(71) Applicant: GEOX S.p.A., Montebelluna (IT)

(72) Inventors: Mario Polegato Moretti, Crocetta del Montello (IT); Marco Bruno, Ivrea (IT); Michele Rampin, Borgoricco (IT)

(73) Assignee: GEOX S.p.A., Montebelluna (IT)

( * ) Notice: Subject to any disclaimer, the term of this patent is extended or adjusted under 35 U.S.C. 154(b) by 64 days.

(21) Appl. No.: 16/648,490

(22) PCT Filed: Sep. 17, 2018

(86) PCT No.: PCT/EP2018/075002

§ 371 (c)(1),
(2) Date: Mar. 18, 2020

(87) PCT Pub. No.: WO2019/057648

PCT Pub. Date: Mar. 28, 2019

(65) Prior Publication Data

US 2020/0221810 A1 Jul. 16, 2020

(30) Foreign Application Priority Data

Sep. 20, 2017 (IT) ..... 102017000104874

(51) Int. Cl.
*A41D 13/002* (2006.01)
*A42C 5/04* (2006.01)

(52) U.S. Cl.
CPC ..... *A42C 5/04* (2013.01); *A41D 13/002* (2013.01); *A41D 2300/20* (2013.01)

(58) Field of Classification Search
CPC ..... A41D 13/002; A42C 5/04
USPC ..... 2/184.5
See application file for complete search history.

(56) References Cited

U.S. PATENT DOCUMENTS 4,569,874 A 2/1986 Kuznetz
6,263,511 B1 * 7/2001 Moretti ..... A41D 31/102 2/97
6,442,760 B2 9/2002 Moretti
2005/0223463 A1 * 10/2005 Mordecai ..... A41D 13/002 2/81
2011/0030120 A1 2/2011 Lin et al.
2016/0331054 A1 11/2016 Coza et al.
(Continued)

FOREIGN PATENT DOCUMENTS

EP 3 093 135 A1 11/2016
JP 2015-96323 A 5/2015

OTHER PUBLICATIONS

International Search Report and Written Opinion dated Dec. 7, 2018 in PCT/EP2018/075002 filed on Sep. 17, 2018.

*Primary Examiner* — Timothy K Trieu
(74) *Attorney, Agent, or Firm* — Oblon, McClelland, Maier & Neustadt, L.L.P.

(57) ABSTRACT

A vapor-permeable insert for item of clothing or accessory, including a collector element adapted to absorb solar radiation, a window element that is transparent to the solar radiation absorbed by the collector element, and an interspace formed between the window element and the collector element, the collector element and the window element being arranged at two opposite faces of the interspace.

11 Claims, 3 Drawing Sheets

(56) References Cited

U.S. PATENT DOCUMENTS

2018/0007986 A1 1/2018 Coza et al.
2018/0317572 A1* 11/2018 Guttman ..... A41D 13/005

* cited by examiner

VAPOR-PERMEABLE INSERT FOR ITEMS OF CLOTHING AND ACCESSORIES, ITEM OF CLOTHING AND ACCESSORIES WITH SAID INSERT

The present invention relates to a vapor-permeable insert for items of clothing and accessories, to an item of clothing and to an accessory for clothing which are provided with said insert.

In order to protect his body against atmospheric agents such as snow, rain, wind and in particular cold weather, man has always worn items of clothing and footwear.

Protection of the human body occurs mainly by resorting to various layers of clothing as a function of the external temperature and of the environmental conditions.

It is thus sufficient to add or remove one or more layers of clothing in order to reach an optimum temperature.

Man has always attempted to provide items of clothing that ensure adequate thermal comfort to him. Thermal comfort is defined in the UNI-EN ISO 7730 standard as: "mental condition of satisfaction with regard to the thermal environment".

The human body is naturally provided with mechanisms that aid it in adapting thermally to the environment in which it is placed.

Man in fact has a very efficient self-regulation system which keeps the internal temperature of the body at a value of approximately 37° C. When the temperature increases too much, two processes are activated: initially, dilation of blood vessels increases blood flow in the skin, then a step of sweating occurs. Sweating is a highly effective cooling method, since the energy used by sweat to evaporate is removed from the skin. In particular, an increase in internal temperature of a few tenths of a degree can stimulate sweating which quadruples energy dispersion from the body.

If body temperature decreases excessively, the first reaction is vasoconstriction, which reduces blood flow in the skin. The second reaction is an increase in energy generation within the body, which occurs by acting on the muscles and thus activating shivering. This system also is efficient and can increase energy production drastically. The control system that regulates body temperature is extremely complex. The two main groups of sensors of the body temperature control system are known and are located in the skin and in the hypothalamus. The sensor located in the hypothalamus is activated in hot conditions and triggers the defense mechanism against heat when the internal temperature rises above 37° C. The sensors located in the skin instead are sensitive to cold and activate the defense mechanism against cold when the temperature of the skin drops below 34° C. If the sensors send signals simultaneously, the human brain inhibits one or both of the defense reactions.

In the prior art, items of clothing are known which allow to provide adequate body thermoregulation. In particular, items of clothing are known in which the outward expulsion of humid warm air occurs by utilizing mainly the natural tendency of humid warm air to rise, which is known as the phenomenon of convection. Among these, U.S. Pat. No. 4,451,934 contains the teachings to provide, inside an item of clothing, channels which are crossed upward from below by the humid warm air. The channels are open toward the inside and at the ends in order to be able to receive and expel the humid warm air, but this exposes the item to the infiltration of liquids, for example water, from the outside inward through the open ends. The technical solution proposed in EP1194049B1, in the name of this same Applicant, solves this drawback by providing an item of clothing which comprises a protective external enclosure with an internal layer which forms inside it an interspace. The internal layer has, at least at the regions of the human body that are most subject to sweating, holes for access to the interspace for the humid warm air, which is channeled inside the interspace by utilizing the "stack effect" (the phenomenon of convection). The internal layer and the external enclosure have, in the apex region of the item of clothing, holes for the evacuation of the humid warm air combined with means for retaining externally water, impurities or others.

However, the "stack effect" is affected by a great dependency on the thermal gradient, i.e., on the difference in temperature between the apex region of the item of clothing, where the humid warm air evacuation holes are located, and the outside environment. The greater the thermal gradient, the greater the "stack effect". This causes a significant decrease of the tendency of the humid warm air to flow out, for example, in the hottest days, since the temperature of the outside environment increases, causing a reduction of the thermal gradient. In the case, for example, of constant relative humidity of the environment, the pressure due to the "stack effect" of an item of clothing manufactured according to the teachings contained in EP 1194049 B1 assumes the value of 1 Pa when the ambient temperature is −5° C., halving its value to 0.5 Pa at 15° C., and drops to 0.36 Pa and 0.23 Pa respectively at 20° C. and 25° C. This means that in passing from 15° C. to 20° C. the thrust to flow out of the item of clothing, which acts on the humid warm air due to the stack effect, decreases by approximately 28%, and from 20° C. to 25° C. decreases by approximately 36%. This value is anything but negligible, considering that over the course of a day a thermal excursion from 15° C. to 20° is very likely.

Furthermore, if the temperature of the outside environment exceeded the temperature of the apex region of the item of clothing, the flow of humid warm air would be pushed a direction which is the opposite of the expulsion direction. The decrease of the "stack effect" causes a simultaneous increase in the internal temperature of the item of clothing, as a consequence of a reduced outflow of the humid warm air, a worsening of the microclimate inside the item of clothing and a feeling of discomfort in the user.

This problem is rendered even more conspicuous by the tendency of the average temperature of planet Earth to increase. As a demonstration of this, the average temperature of the planet has reached the highest ever values each year over the three-year period 2014-2015-2016. This inconvenience is known, for example, in the design of buildings for civil use, where effective air replacement is necessary. In order to obtain a thermal gradient value that is sufficient to ensure the outward expulsion of stale air, an air space or interspace is provided on the roof of buildings. Said air space comprises: in a downward region, first openings and a dark collector covered by a sheet of glass, and in an upward region second openings. The air contained in said air space is heated due to the heat of the sun, reduces its density and rises, exiting from the second openings. At the same time it draws further air from the first openings.

The aim of the present invention is to provide a vapor-permeable insert for item of clothing or accessories that is capable of improving the prior art in one or more of the aspects indicated above.

Within this aim, an object of the invention is to provide a vapor-permeable insert for item of clothing or accessory that allows effective thermoregulation at different latitudes even in the presence of a significant temperature range.

Another object of the invention is to provide a vapor-permeable insert for item of clothing or an accessory that ensures adequate replacement of the air inside it.

A further object of the invention is to provide a vapor-permeable insert for item of clothing or accessory that lacks complex adjustment systems that require intervention on the part of the user.

Another object of the invention is to provide a vapor-permeable insert for item of clothing or accessory that allows quick adaptation to the variation of the irradiance conditions, for example when passing from a full sunlight condition to an overcast sky or shade condition.

Another object of the invention is to provide a vapor-permeable insert for item of clothing or accessory in which the operation of the thermoregulation has a low environmental impact and uses natural mechanisms, such as for example solar irradiance.

Another object of the invention is to provide a vapor-permeable insert for item of clothing or accessory which, while allowing the outflow of the water vapor produced by sweating, prevents infiltrations of water from the outside, thus ensuring the waterproofness of the item of clothing to be worn.

A further object of the present invention is to overcome the drawbacks of the prior art in a manner that is alternative to any existing solutions.

Another object of the invention is to provide an item of clothing or an accessory for clothing that is highly reliable, relatively easy to provide and at competitive costs.

This aim, as well as these and other objects which will become better apparent hereinafter, are achieved by an insert for item of clothing or accessory, according to the invention, which comprises: an interspace, a collector element adapted to absorb solar radiation at least partially, and a window element that is transparent to a given range of frequencies of solar radiation, which are arranged oppositely with respect to the interspace, with the collector closer to the body of the user.

Further characteristics and advantages of the invention will become better apparent from the description of some preferred but not exclusive embodiments of the insert according to the invention, illustrated by way of nonlimiting example in the accompanying drawings, wherein.

Figure 4A:
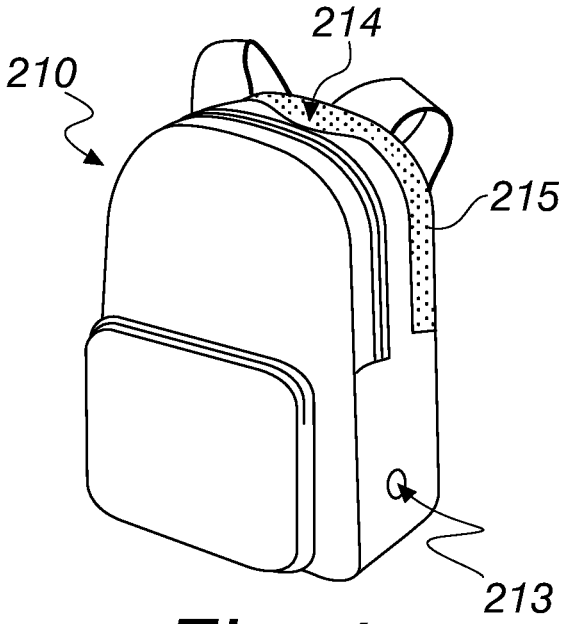
Figure 4B:
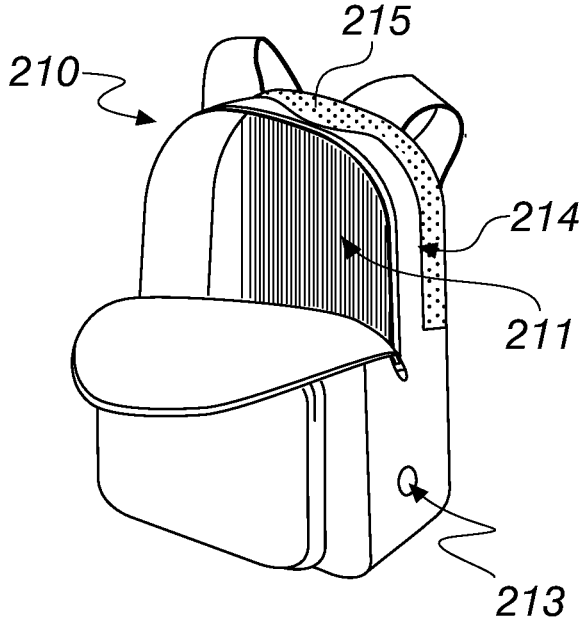
Figure 5:
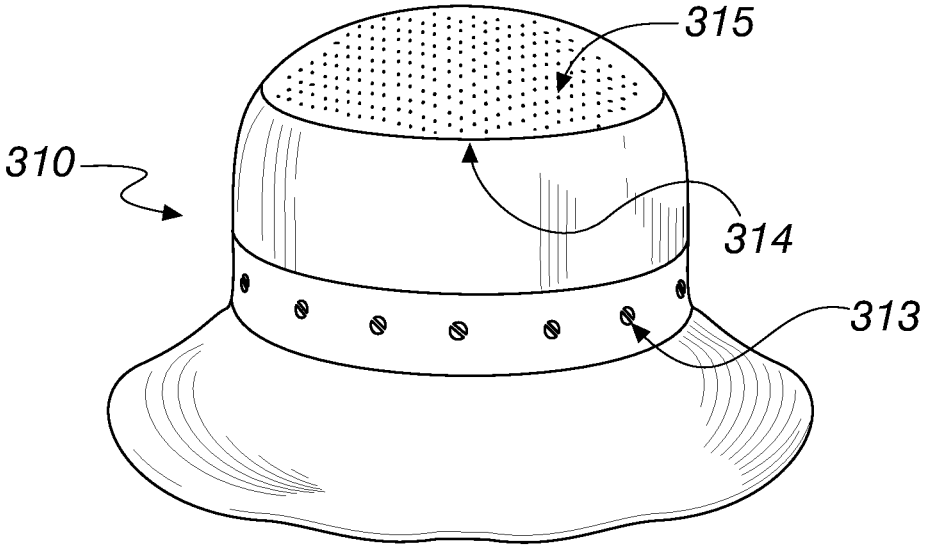

FIGS. 4*a* and 4*b* are views of a rucksack with an insert according to the invention;

FIG. 5 is a view of a hat with an insert according to the invention.

Figure 1:
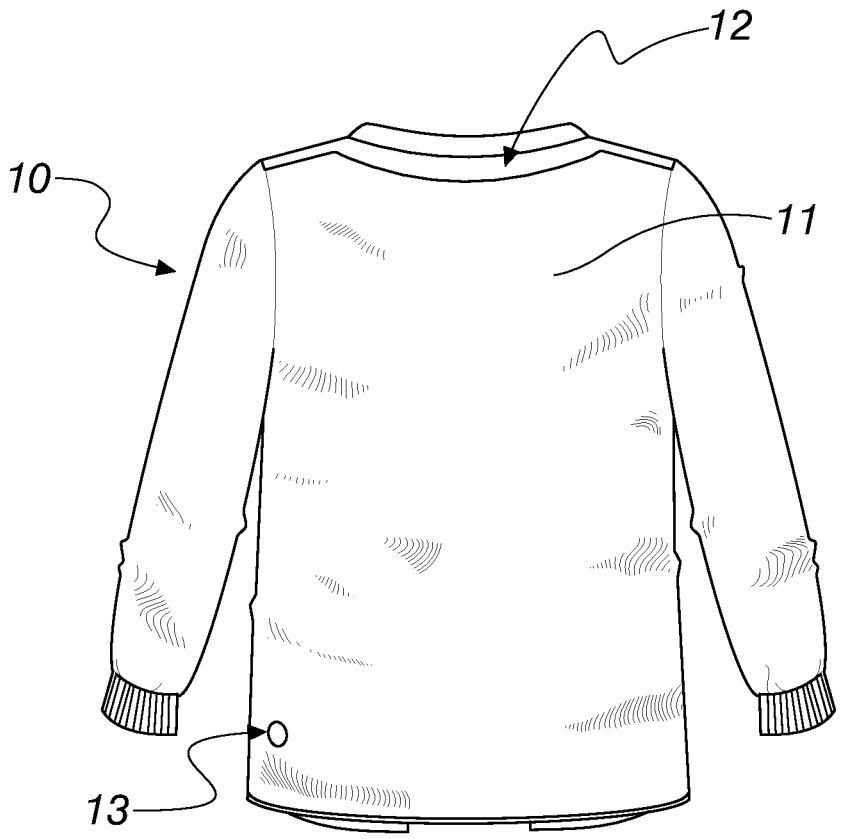
FIG. 1 is a view of an item of clothing with an insert according to the invention.

With reference to the figures, an item of clothing provided with an insert according to the invention is designated generally by the reference numeral 10 and is shown in FIG. 1. The item of clothing of the example is a vapor-permeable jacket and comprises a vapor-permeable internal lining 19 and an outer shell 11, which has at least one first opening 12 arranged advantageously in the apex region of the item. An insert 14 is arranged at said first opening.

The insert 14 is constituted by a window element 15 and by a collector element 16, which are arranged so as to form an air space or an interspace between the window element 15 and the collector element 16. In particular, the window element 15 corresponds to the external face of the insert 14, while the collector element 16 represents the internal face of the insert 14 and is directed toward the vapor-permeable lining 19. Therefore, the collector element 16 and the window element 15 are arranged oppositely with respect to the interspace, with the collector element 16 closer to the body of the user. By virtue of this arrangement, the window element 15 is directed toward the outside environment and can be adjacent to the external surface of the item of clothing.

In particular, the collector element 16 is constituted by a synthetic fabric or by a portion of polymeric material or the like. Preferably, the collector element 16 is vapor-permeable. Even more preferably, the collector element 16 is permeable to humid warm air. Advantageously, it is capable of absorbing the visible portion of solar radiation and in this case it is dark, preferably black. The collector is made of materials capable of absorbing the portion of solar radiation that corresponds substantially to the infrared (IR) spectrum, which, despite having a lower intrinsic energy than the ultraviolet spectrum (UV), is however a larger portion of solar radiation. This proportion affects insolation, i.e., the quantity of solar radiation that reaches directly the surface of the earth through the atmosphere without interacting with atmospheric gases. The insolation of the surface of the earth is in fact equal to 1000 $W/m^2$ in fair weather conditions at sea level when the sun is at the zenith. The zenith is defined as the position of the sun, with respect to the Earth, in which the rays of the sun are perpendicular to the surface of the Earth. In these conditions, approximately 525 $W/m^2$ are due to IR radiation, 445 $W/m^2$ are due to visible radiation and only 30 $W/m^2$ are due to UV radiation.

The main purpose of the collector element 16 is to absorb as much as possible the solar radiation that has arrived through the window element 15 and is incident thereon, and emit it, by conduction and/or radiation, heating the air contained in the interspace of the insert 14. As the temperature of the collector element 16 rises, the contribution caused by radiation becomes considerable with respect to the contribution due to conduction, since the quantity of heat emitted by radiation is proportional to the fourth power of the temperature. Therefore, the collector element is constituted by a material that is capable of absorbing at least part of solar radiation, preferably from UV to IR, and subsequently emitting it in the form of thermal radiation, i.e., heat. In particular, the wavelength interval of interest for the invention is the one comprised between 100 nm and 15,000 nm.

The materials of which the collector element 16 is made comprise for example graphene and fabrics obtained starting from synthetic fibers with the addition of ceramic materials such as zirconium carbide, ZrC, or titanium dioxide, $TiO_2$.

With particular reference to fabrics, the properties of absorbing, transmitting and/or reflecting electromagnetic radiation depend also on characteristics of the structure of the fabric and of the yarn that composes it.

For example, the chemical composition is important and determines absorption peaks or windows of radiation transmission: for example, the presence of expanded polytetrafluoroethylene (ePTFE) generates a window of transmission of radiations having a wavelength comprised between 3000 and 5000 nm and between 9000 and 12,000 nm. The presence of carbon-carbon bonds or carbon-hydrogen bonds, as occurs for example in polyethylene, generates absorption peaks limited to the wavelengths astride 3400, 3500, 6800, 7300 and 13,700 nm. Furthermore, with reference for example to the band of radiation having a wavelength comprised between 830 and 1700 nm, a fabric composed of 92% polyester fibers and 8% elastane fibers with the addition of 1.8% by weight of $TiO_2$ shows an absorbance of approximately 40%, while the same fabric without $TiO_2$ has almost no absorbance. The term absorbance is understood as the ratio between the energy absorbed and the energy that is incident on a body; for the purposes of the present invention, it is understood as the ratio between absorbed electromagnetic radiation and incident electromagnetic radiation, which in each instance refers to one or more electromagnetic radiation intervals expressed as wavelength intervals.

Porosity is important: for example, the presence of nanopores with a diameter comprised between 50 and 1000 nm in polyethylene (nanoporous polyethylene) provides a transmittance of over 90% regarding wavelengths greater than 2000 nm and an opacity to visible light of more than 90%; this differentiates nanoporous polyethylene from conventional polyethylene, since the latter, while having a similar transmittance referred to wavelengths greater than 2000 nm, is however almost transparent to visible light. The term transmittance is understood as the ratio between transmitted energy and the energy that is incident on a body; for the purposes of the present invention, it is understood as the ratio between transmitted electromagnetic radiation and incident electromagnetic radiation, which in each instance refers to one or more electromagnetic radiation intervals expressed as wavelength intervals.

The dimension of the fibers (i.e., the set of fibrous products which, due to their structure, length, strength and elasticity, have the property of joining, by spinning, in thin, tough and flexible threads) and of the yarn (i.e., the set of fibers held together by twisting so as to form a thread) is also important. For example, transmittance referred to wavelengths comprised between 3000 and 5000 nm and between 9000 and 12,000 nm of a polyethylene fabric composed of a yarn with a diameter of 30 microns is equal to 0.76 when the fibers that compose the yarn have a diameter of 10 microns and is equal to 0.972 when the fibers that compose the yarn have a diameter of 1 micron. The following are also important: the degree of twisting, since a more twisted yarn is less absorbent, as its more compact structure is also more reflective; combing, since it produces a more orderly arrangement of the textile fibers after carding and has a higher reflective characteristic; the type of fiber, since if it is of the continuous filament type it has a greater surface uniformity and therefore a higher reflective characteristic than a staple fiber. The presence of delustrants or opacifiers, of organic or inorganic pigments, which can increase infrared absorption, and of coatings which can modulate the breadth of the spectrum of absorbed solar radiation, is also important.

For example, the presence of pigments that contain tin dioxide ($SnO_2$) or antimony dioxide ($SbO_2$) increases IR absorption. In particular, the pigment known by the trade name Iriotec® 9230 and manufactured by Merck KgaA exhibits an absorbance of approximately 30% at a wavelength of 1000 nm, approximately 40% at a wavelength of 1250 nm and greater than approximately 60% at wavelengths greater than 1500 nm. Heating of the air space occurs due to the part of solar radiation that is absorbed and subsequently released.

A fabric suitable for the provision of the collector element 16 is, for example, the fabric known by the trade name Thermotron, of the company Unitika Lt. Japan, constituted by 95 parts of polyester and five parts of ZrC, wherein the molecules of ZrC absorb solar radiation which has a wavelength of less than 2 μm and convert it into heat in the form of IR radiation, thus heating the interspace.

The window element 15 is constituted by a layer of polymeric material, which is advantageously coupled to one or more supporting layers, or by a synthetic fabric. The window element 15 is transparent to a given range of frequencies comprised within solar radiation. Preferably, the window element 15 is transparent at the range of frequencies that corresponds to visible light (wavelength comprised substantially between 400 and 700 nm) and/or to infrared radiation (wavelength comprised substantially between 700 and 15,000 nm). The term "transparent" is understood to mean that at least 30% of a given range of frequencies that compose the incident radiation passes through the window element 15. The window element 15, for example, can comprise a sheet of polymeric material that is transparent to the visible light spectrum, or a fabric that is transparent to the IR and/or UV spectrum. Further examples of materials suitable to constitute the window are described hereinafter, with reference to the first embodiment. In particular, the window element 15 has a thickness comprised between 0.1 and 3 mm: this thickness is sufficient to ensure resistance to the stresses and impacts to which the item is subjected. Advantageously, the window element 15 can be treated with dyes and/or finishes that are adapted to increase its transparency or non-transparency at one or more frequency ranges.

The window element 15 contributes to heat the interspace by conduction and/or radiation, since a direct exposure to solar radiation causes a significant heating thereof.

The interspace or air space separates the collector element 16 from the window element 15.

Figure 2:
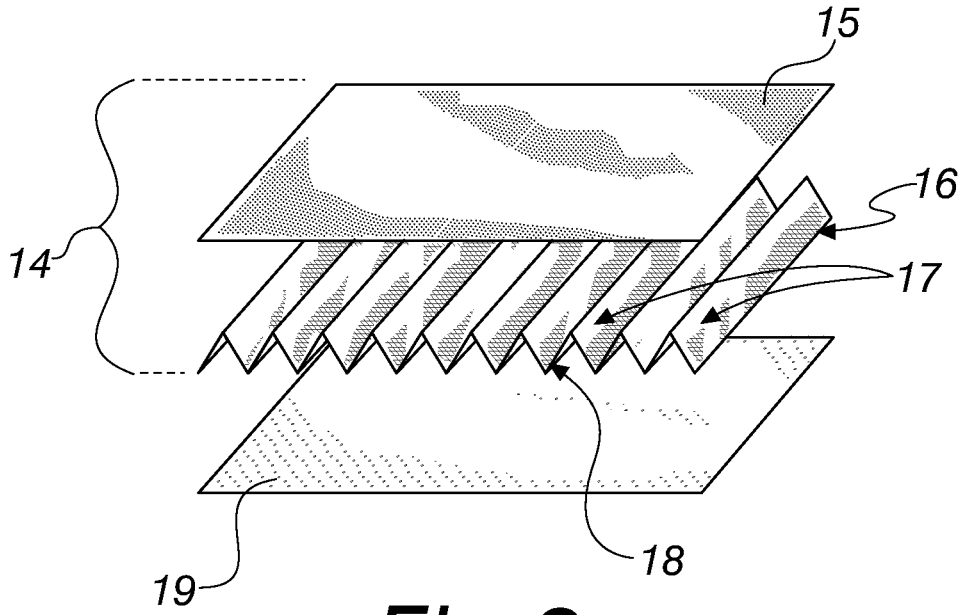
FIG. 2 is an exploded perspective view of a portion of the insert according to the invention.

In a first embodiment thereof, shown in FIG. 2, the collector element 16 forms the interspace with its structure.

With reference to FIG. 2, the collector element is provided by means of a three-dimensional fabric.

The expression "three-dimensional fabric" is commonly understood to reference a single fabric the fibers the component fibers of which are arranged in a mutually perpendicular planar relationship. From the point of view of the production process, in a weave of the three-dimensional type, the sets of fibers X and Y are interwoven with the rows and columns of the axial fibers Z. The expression "sets of fibers X and Y" is understood to reference respectively the horizontal and vertical weft sets. The expression "Z fibers" is understood to reference the set of multilayer warp. It is possible to obtain three-dimensional fabrics also with weaving processes of a two-dimensional type. The three-dimensional fabric can be obtained also by knitting on flat or circular knitting machines. The volume occupied by the three-dimensional fabric is filled by air for a significant extent. As an alternative, the interspace can be obtained for example by interposing between the window element 15 and the collector element 16 a spacer layer, substantially with the same transparency as the window element 15, which is constituted for example by strips or pins which are interposed between the window element 15 and the collector element 16 (for example molded or heat-sealed to either the window 15 or the collector element 16).

The humid warm air enters the interspace, utilizing the "stack effect", through the collector element 16. If the collector is scarcely or not at all permeable to humid warm air, it is possible to provide thereon openings for the entry of the humid warm air. These openings cause locally a constriction of the useful cross-section for the passage of humid warm hair, which consequently increases its speed due to the so-called "Venturi effect", entering the interspace more easily. Furthermore, it is preferable that the ratio between the surface of the collector element 16 and the cross-section of the entry openings be as high as possible in order to maximize the Venturi effect and simultaneously have a surface of the collector element 16 that is extended so as to maximize the heating of the air contained in the interspace.

The humid warm air, heated further by the heat released by the collector element 16 and, to a lesser extent, by the window element 15, reduces its own density, drawing further air into the interspace. Then it rises, again utilizing the "stack effect", and exits from the interspace toward the outside environment through the at least one exit opening 12.

If the external temperature increases, due to higher solar irradiation, the temperature of the collector element increases as well, due to the greater intensity of the portion of solar radiation that it absorbs. At the same time, the temperature of the window also increases, due to the increase in insolation, thus increasing the temperature gradient with the outside environment and therefore the outflow of humid warm air by stack effect.

If instead solar irradiation decreases, for example due to the onset of clouds or due to reduced direct exposure to solar radiation, the temperature of the collector element decreases, reducing the outflow of humid warm air due to the stack effect. The insert acts as a sort of "solar chimney", which in full sunlight conditions increases the "stack effect", and vice versa. The "solar chimney" is capable of self-regulating. The "solar chimney" utilizes solar radiation, which is the main cause of the increase of the temperature of the environment and of the increase of the temperature perceived by the user of the item of clothing, in order to increase the outflow of humid warm air contained within the item of clothing, improving user comfort.

It should also be understood that in conditions of lack of exposure to solar radiation the "stack effect" persists, as known in the background art, without the contribution that would render it a "solar chimney" described above.

Advantageously, the at least one opening 12, for the outflow of the humid warm air, can be combined with means for retaining externally water, impurities or others. For example, it is possible to use: sliding flat elements, flaps, external enclosures made of a material known commercially by the name "STOMATEX" or the like, one-way valves, mushroom-shaped elements, waterproof and vapor-permeable membranes.

An element is understood to be impermeable to water if fewer than three crossing points are observed when it is subjected to a column of water of at least 1000 mm. In particular, waterproofness is assessed as resistance of the specimen to the penetration of water under pressure according to the EN 20811:1992 standard. A specimen of material, having a surface of 100 $cm^2$, is fixed in the testing head in a horizontal position, so as to not slip between the clamps and without forming protrusions. Furthermore, there must be no leakage of water at the clamps. The specimen is subjected to a water column that increases constantly and acts above or below the specimen. The distilled or deionized water is at a temperature of 20±2° C. or 27±2° C., and the rate at which the water column increases is 10±0.5 $cmH_2O$/min or 60±3 $cmH_2O$/min, wherein 1 $cmH_2O$ is equivalent to approximately 1 mbar.

Hereinafter, unless otherwise specified, the term "impermeable" is understood as "impermeable to water".

Vapor-permeability is instead determined according to the method described in chapter 6.6 of the ISO 20344-2004 standard. The ISO 20344-2004 standard, in chapter 6.6 "Determination of water vapour permeability", which relates to safety shoes, describes a testing method that consists in fixing a specimen of the material being tested so as to close the opening of a bottle that contains a certain quantity of dry desiccant, i.e., silica gel. The bottle is subjected to a strong air current in a conditioned atmosphere. The bottle is made to rotate in order to stir the dry desiccant and optimize its action of drying the air contained in the bottle. The bottle is weighed before and after the testing period in order to determine the mass of humidity that is passed through the material that is and has been absorbed by the solid desiccant. Permeability to water vapor, expressed in milligrams per square centimeter per hour [$mg/cm^2 \cdot h$], is thus calculated on the basis of the mass of humidity measured, of the area of the opening of the bottle and of the testing time.

"Vapor-permeable" and "breathable" are used alternatively hereinafter, both with the same meaning.

With reference to FIGS. 1 and 2, the insert 14, arranged in the opening 12 of the apex region of the item 10, comprises a window element 15 which is made of waterproof and vapor-permeable polymeric material, for example expanded polytetrafluoroethylene (ePTFE), which is transparent in the intervals 3000-5000 nm and 9000-12,000 nm of electromagnetic radiation, according to the teachings of patent document EP 2212642 B 1.

On the opposite face of the insert, toward the vapor-permeable internal lining 19, there is a collector element 16, made of three-dimensional fabric, which forms with its structure an interspace that is delimited in an upward region by the window element 15.

The three-dimensional fabric is composed of synthetic fibers, such as for example polyester, polyethylene, or the like, and ceramic materials, such as for example zirconium carbide, ZrC, or titanium dioxide, $TiO_2$, which increase the absorption of the electromagnetic radiation that passes through the window element 15. Due to the principle of energy conservation, the amount of energy that is associated with the electromagnetic radiation that is absorbed is radiated back, consequently heating the air contained in the interspace and giving rise to the phenomenon of the solar chimney described previously.

The three-dimensional fabric of which the collector element 16 is constituted has ribs 17 spaced by channels 18 which are directed toward the window element 15 and/or toward the body of the user. The channels 18 define preferential paths for the passage of the humid warm air. The term "preferential" in the context of the patient of the patent has the meaning of "subject to preference" on the part of the sweat in the vapor phase, which, when it encounters a material that has a region with passages and region without passages, is attracted by the passages and is subject to "prefer" them. Accordingly, it is subject to prefer the region that contains the passages with respect to the region that lacks them.

In the first embodiment, shown in FIG. 2, the channels 18 are directed toward the window element 15.

A structure with ribs and channels is the one of the fabric contained in the teachings of patent document EP2007235B1 in the name of the same Applicant.

The opening 12, provided in the apex region of the item 10, has an extension that can be compared with that of the window element 15.

Advantageously, the item of clothing 10 comprises one or more ventilation openings 13 which are arranged for example along the hips or at the armpits. The one or more ventilation openings 13 help to feed the flow of air that is drawn into the interspace. The one or more ventilation openings 13 can be provided with means for the external retention of liquids and/or dirt, or impermeable means.

The lining 19, arranged on the face of the collector element 16 that is external to the insert 14, is in contact with the body of the user.

Advantageously, the lining 19 is permeable to the humid warm air and is preferably provided with openings.

The window element 15 can be also made of materials with transparency at broader frequency ranges. For example, it can be made of a nanoporous polyethylene fabric characterized by interconnected pores with a diameter of 50-1000 nm, or of a fabric constituted by polyethylene with a fiber diameter of 1 μm and a yarn diameter of 30 μm. These fabrics are transparent to a wide range of infrared light but not to visible light, as described previously. At the same time, they are not transparent to the human eye and therefore appear as normal fabrics.

In particular, nanoporous polyethylene allows the passage of approximately 96% of infrared radiation, while for example cotton stops at just 1.5%. This property of nanoporous polyethylene allows to utilize almost completely the IR range of solar radiation for the operation of the "solar chimney". These types of fabric can advantageously be rendered impermeable, for example by means of known electrospinning processes.

In one variation of the first embodiment, the window element 15 is made of waterproof and vapor-permeable polymeric material which is transparent to visible light, for example polyurethane (PU) or polyester. In this case, the collector element 16 is dark in color in order to absorb the visible light that penetrates through the window element 15 and increase in this manner the heating of the air contained in the interspace. As an alternative, the dark collector element 16 is made of a vapor-permeable layer of granules made of expanded polymeric material. The interstices between the granules, made of expanded polymeric material, create convoluted paths for the humid warm air inside the interspace. In this manner they increase its internal retention time and the heating to which it is subjected. This leads to a further increase of the temperature of the humid warm air that exits from the item, amplifying the "solar chimney" phenomenon.

Figure 3:
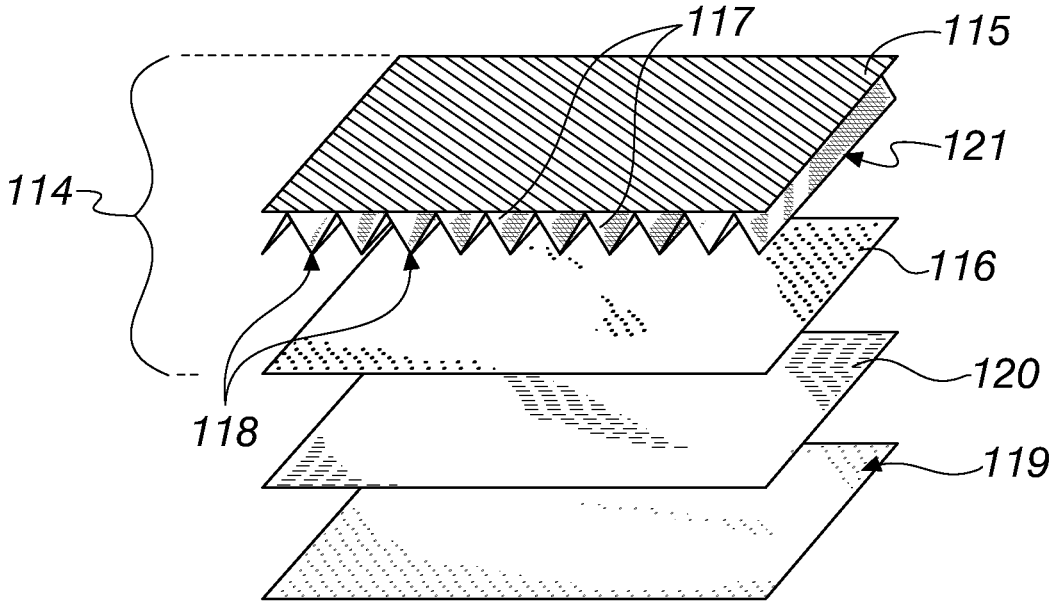
FIG. 3 is an exploded perspective view of a portion of an insert according to the invention in a constructive variation thereof.

In a constructive variation, shown in FIG. 3, the interspace of the insert 114 is formed in an upward region by a window element 115 which is made of vapor-permeable fabric, such as for example a fabric made of polyester or polyamide, and in a downward region by a collector element 116 which is made of waterproof and vapor-permeable material capable of absorbing at least part of the solar radiation. The material that constitutes the collector element 116, for example, can be polyurethane (PU) containing graphene, or ePTFE with a surface coating comprising PU and graphene. Graphene has excellent properties of absorption of solar radiation in a spectrum that ranges from UV to IR. Optionally, the collector element 116 is coupled to a vapor-permeable mesh 120.

The window element 115 is made of a fabric that is transparent to a wide range of infrared rays. For example, a nanoporous polyethylene fabric, characterized by interconnected pores with a diameter of 50-1000 nm, or a fabric composed of polyethylene with a fiber diameter of 1 μm and a yarn diameter of 30 μm.

Advantageously, a spacer element 121 made of three-dimensional fabric that is permeable to humid warm air is interposed between the window element 115 and the collector element 116. The spacer element 121 can comprise ridges 117 which are interleaved by channels 118 directed toward the window element 115 and/or toward the body of the user.

The spacer element 121 substantially has the same transparency as the window element 115. The spacer element 121 is coupled to the window element 115, for example by sewing, adhesive bonding or high-frequency welding.

A lining 119 which is in contact with the body of the user, is permeable to humid warm air and is preferably provided with openings is arranged on the face of the collector element 116 that is coupled to the mesh element 120 and is external to the insert 114.

In another constructive variation of the insert 114, which is not shown in the figures, the window element 115 is constituted by a three-dimensional fabric, which can comprise ribs spaced by channels. In this variation, the presence of the spacer element 121 is not necessary and therefore the spacer element 121 is not present.

An item of clothing provided with the vapor-permeable insert according to the invention can advantageously comprise an external fabric that is capable of reflecting a significant portion of IR and/or UV in the regions where there is no interspace. In this manner, the contribution to overall warming inside the item that said portion would provide, if it were not reflected, is limited.

If the collector element has a limited permeability to humid warm air, it is possible to arrange thereon openings for the entry of the latter. The openings determine a local constriction of the useful cross-section for the passage of humid warm air. Accordingly, the humid warm air increases its speed, due to the Venturi effect, entering the interspace more easily. Furthermore, preferably the ratio between the surface of the collector element and the cross-section of said entry openings is as high as possible in order to maximize the Venturi effect. At the same time, a surface of the collector element is extended in order to maximize the heating of the air contained in the interspace.

The insert, composed of the window element, the collector element and the interspace formed by them, can be arranged in multiple regions of a same item of clothing or accessory, according to the requirements: for example, it can be arranged along the hips of an item of clothing.

FIGS. 4*a* and 4*b* show a bag, in the specific case a rucksack 210. The rucksack 210 comprises, in the apex region, an insert 214 according to the invention, which is formed externally by a window element 215 and internally by a collector element. The insert 214 is provided in one of the variations described above and shown schematically in FIGS. 2 and 3. The materials used to provide the window element 215 and said collector element can be chosen conveniently among the ones described above.

This embodiment is particularly advantageous for rucksacks suitable to transport an electronic device which, during use, produces a certain quantity of heat, such as for example devices provided with microprocessors, and the cooling of which requires a certain time even once it has been shut down or placed in standby. The generated heat in fact must be able to move away from the electronic device in the presence of any weather condition both to allow effective cooling thereof in short times and to avoid producing condensation. This last situation occurs if the generated heat remains confined in the immediate vicinity of the electronic device and cools down there.

The rucksack advantageously contains a spacer layer 211 adapted for the resting of the electronic device once it has been stored in the rucksack. The spacer layer 211 assists the warm and the water vapor in rising toward the interspace of the insert 214.

Advantageously, the rucksack 210 comprises one or more ventilation openings, for example holes 213, which can be provided with means for the external retention of liquids and/or dirt, or waterproof, in order to facilitate the exchange of air inside the rucksack. The ventilation holes 213 are preferably arranged in the lower portion of the rucksack 210, so as to facilitate ventilation starting from the lower rucksack portion.

FIGS. 4*a* and 4*b* show a rucksack, but the insert according to the invention can be applied to any type of bag.

FIG. 5 shows a headgear 310 which comprises an insert 314 according to the invention. The headgear 310 is provided with an insert 314 at least in the apex region of the crown. The insert 314 comprises a collector element, which is arranged inside the crown, toward the body of the user, and a window element 315 that is arranged outward.

The term "crown" is understood to reference the portion of the headgear the internal volume of which is extended substantially starting from an upper portion of the parietal and frontal bone of the head of the user. Said internal volume can accommodate at least part of the head of the user.

The insert 314 is provided in one of the variations that are described above and shown schematically in FIGS. 2 and 3. The materials used to provide the window element 315 and said collector element can be conveniently chosen among the ones described above.

Advantageously, the headgear 310 comprises one or more ventilation openings, for example holes 313, which can be provided with means for the external retention of liquids and/or dirt, or impermeable means, in order to facilitate the exchange of air inside the headgear 310. Preferably, the ventilation holes are arranged in the lower portion of the crown so as to facilitate ventilation starting from the lower headgear portion.

Depending on the requirements, the window element 315, the collector element and the interspace, formed by them, can be located in one or more portions of the crown, not necessarily in the apex region.

In a constructive variation, the window element 315, the collector element and the interspace formed by them can be extended over the entire crown.

Operation of the insert according to the invention, applied to an item of clothing or to an accessory, is as follows.

Solar radiation, and in particular infrared solar radiation, passes through the window element, which is transparent to it, and is absorbed by the collector element. The collector element absorbs the radiation and radiates its back into the interspace, heating the air that is present inside.

The air that is present in the interspace rises due to the stack effect and exits from the insert, drawing air from below. The humid warm air that is produced for example by sweating passes through the collector element, entering the interspace, both due to its own stack effect and because it is drawn by the air that exits from the insert according to the invention. The humid warm air, further heated due to the heat released by the collector and, to a lesser extent, by the window, decreases its own density, drawing further air into the interspace and, by rising, again utilizing the stack effect, exits from the interspace toward the external environment through at least one exit opening, which is arranged at the insert.

In practice it has been found that the invention achieves the intended aim and objects, providing a vapor-permeable insert, applicable to items of clothing and accessories, that is capable of triggering a stack effect, with any climate condition of the outside environment, such as to produce an evacuation of warm air from the item to which it is applied.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102017000104874 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A vapor-permeable insert for an item of clothing or accessory, comprising:

a collector element that absorbs solar radiation with a wavelength comprised between 100 nm and 15.000 nm;

a window element that is transparent to the solar radiation absorbed by the collector element; and an interspace formed between said window element and said collector element, wherein said collector element and said window element are arranged at two opposite faces of said interspace.

2. The vapor-permeable insert for an item of clothing or accessory, according to claim 1, wherein said collector element is configured to absorb an infrared and visible portion of solar radiation.

3. The vapor-permeable insert for an item of clothing or accessory, according to claim 1, wherein said collector element is made of synthetic fabric or the like.

4. The vapor-permeable insert for an item of clothing or accessory, according to claim 3, wherein said collector element is made of a three-dimensional fabric.

5. The vapor-permeable insert for an item of clothing or accessory, according to claim 4, wherein said interspace is defined by the structure of the collector element which is provided with ribs spaced by channels.

6. The vapor-permeable insert for an item of clothing or accessory, according to claim 1, wherein said collector element is made of waterproof and vapor-permeable polymeric material or the like.

7. The vapor-permeable insert for an item of clothing or accessory, according to claim 1, wherein said window element is constituted by a layer of waterproof polymeric material or the like.

8. The vapor-permeable insert for an item of clothing or accessory, according to claim 1, wherein said window element is made of synthetic fabric or the like.

9. The vapor-permeable insert for an item of clothing or accessory, according to claim 1, further comprising:

a spacer element interposed between said collector element and said window element.

10. An item of clothing, comprising:

at least one opening, wherein at least one vapor-permeable insert according to claim 1 is arranged at said at least one opening with said collector element directed toward the body of the user, and said window element facing said opening.

11. The item of clothing according to claim 1, further comprising:

at least one ventilation opening.

* * * * *